United States Patent [19]

Nottorf

[11] Patent Number: 4,722,886

[45] Date of Patent: Feb. 2, 1988

[54] PROCESS FOR PREPARING A PHOTOGRAPHIC EMULSION CONTAINING TABULAR GRAINS HAVING NARROW SIZE DISTRIBUTION

[75] Inventor: Robert W. Nottorf, Hendersonville, N.C.

[73] Assignee: E. I. Du Pont de Nemours and Company, Wilmington, Del.

[21] Appl. No.: 917,504

[22] Filed: Oct. 10, 1986

[51] Int. Cl.[4] ..... G03C 1/02; G03C 1/46

[52] U.S. Cl. ..... 430/569; 430/502; 430/567; 430/966

[58] Field of Search ..... 430/502, 567, 569, 966

[56] References Cited

U.S. PATENT DOCUMENTS

| | | | |
|---|---|---|---|
| 4,386,156 | 5/1983 | Mignot | 430/567 |
| 4,425,426 | 1/1984 | Abbott et al. | 430/502 |
| 4,434,226 | 2/1984 | Wilgus et al. | 430/567 |

OTHER PUBLICATIONS

Research Disclosure 2312, Aug. 1983, "Tabular Grain Silver Bromide Emulsions . . . ", pp. 261–263.

*Primary Examiner*—Richard L. Schilling
*Assistant Examiner*—Patrick Doody

[57] ABSTRACT

Process for preparing a photographic emulsion containing tabular silver halide grains which have narrow size distribution comprising:

A. adding silver nitrate to a vessel containing dispersing medium/bromide mixture, initial bromide ion concentration is 0.08 to 0.25 N to form tabular seed grains;

B. adding a basic silver halide solvent, e.g., ammonia, ammoniacal solution, etc. to achieve 0.02 N to 0.2 N of the solvent (e.g., after at least 2% by weight of total silver nitrate has been added);

C. stopping silver nitrate addition for 0.5 to 60 minutes, e.g., bromide ion concentration is in the range of 0.005 to 0.05 N;

D. neutralizing at least some of the basic silver halide solvent present; and

E. adding additional silver nitrate and halide, i.e., $Br^-$ and $BrI^-$, by balanced double jet procedure.

The emulsions are used in photographic elements for x-ray, graphic arts, etc.

12 Claims, 1 Drawing Figure

PROCESS FOR PREPARING A PHOTOGRAPHIC EMULSION CONTAINING TABULAR GRAINS HAVING NARROW SIZE DISTRIBUTION

TECHNICAL FIELD

This invention relates to a process for preparing a photographic emulsion containing tabular silver halide grains. More particularly this invention relates to a process for preparing a photographic emulsion wherein the tabular silver halide grains have a narrow size distribution.

BACKGROUND OF THE INVENTION

Tabular silver halide grains, their preparation and use in photographic emulsions, are widely known. They have been extensively studied in the literature since photographic emulsions containing these grains appeared to offer some significant advantages over photographic emulsions containing round or globular grains (e.g., splash prepared types). Generally, tabular grains are large, flat silver halide grains that are prepared by employing long ripening times or by balanced double jet (BDJ) precipitation methods. Commercial emulsions using tabular grains are conventionally made by using a BDJ process. The tabular grains usually have triangular parallel crystal faces each of which is usually larger than any other crystal face of the grain and are conventionally defined by their aspect ratio (AR) which is the ratio of the diameter of the grain to the thickness. Tabular grains of varying thicknesses and AR's have been found to be useful in photographic systems. Larger AR grains, e.g., at least 8:1, have diameters of at least 0.6 μm and thicknesses of less than 0.3 μm. These larger tabular grains have certain commercial advantages apparent to those of normal skill in the art. For example, they have a larger surface area and thus can accept more sensitizing dye. Since these tabular grains usually are dye sensitized, when emulsions using such tabular grains are present in medical x-ray elements an increase in sharpness can result. In addition, since the tabular grains normally lie flat when coated from an emulsion on a support, the covering power is usually greater and thus the emulsions can be coated at a lower coating weight and is therefore less costly. In the known processes for preparing tabular silver halide grains, grain growth conditions which promote tabularity have not promoted narrow grain size distribution. It is therefore desired to prepare photographic emulsions containing tabular grains having a narrow size distribution.

BRIEF DESCRIPTION OF DRAWING

In the accompanying drawing which forms a material part of this disclosure.

SUMMARY OF THE INVENTION

Figure 1:
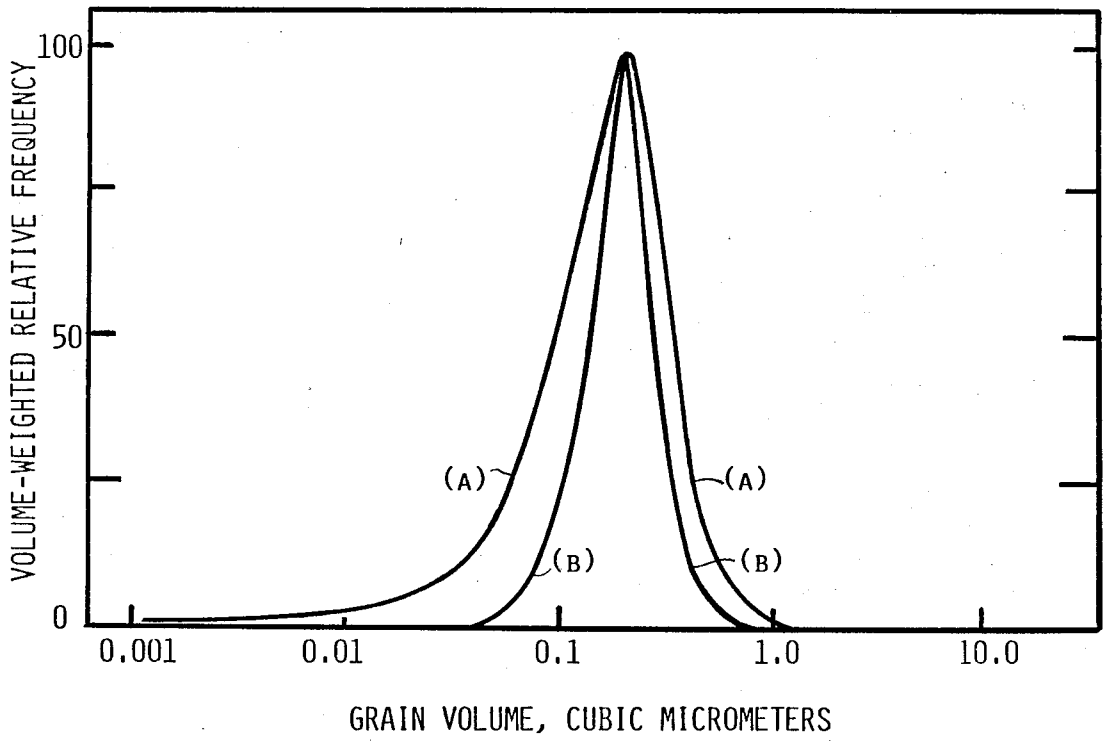
FIG. 1 are curves comparing the tabular grain size distribution of emulsions made according to known procedure (Curve A) and according to this invention (Curve B). In the FIGURE, the curves are made by plotting the volume-weighted relative frequency at which the grains occur vs. the grain volume in cubic micrometers ($\mu m^3$). In each curve a bell-shaped curve is achieved indicating that there are less small and large tabular grains compared to the intermediate size tabular grains. The width of the curve is a direct indication of the dispersity of the sizes. Curve A showing a relatively wide grain size distribution illustrates a dispersity of 2.0 or above. Curve B showing a relatively narrow distribution of grain volumes illustrates a dispersity of about 1.52.

In accordance with this invention there is provided a process for the preparation of a photographic emulsion containing tabular silver halide grains having a narrow size distribution comprising A. adding silver nitrate to a vessel containing a dispersing medium/bromide mixture wherein the initial bromide ion concentration is 0.08 to 0.25 normal whereby tabular seed grains are formed;

B. adding a basic silver halide solvent to achieve 0.02 to 0.2 normal of the solvent after at least 2% by weight of the total silver nitrate has been added to said vessel;

C. stopping silver nitrate addition for a time period of 0.5 to 60 minutes to permit the tabular seed grains to ripen wherein the bromide ion concentration is in the range of 0.005 to 0.05 normal;

D. neutralizing at least some of the solvent that is present; and

E. adding silver nitrate and halide taken from the group consisting of $Br^-$ and $BrI^-$ by balanced double jet addition whereby the tabular grains of narrow size distribution are formed.

DETAILED DESCRIPTION OF THE INVENTION

The process of this invention results in photographic emulsions containing tabular silver halide grains which have a narrow size distribution when compared to tabular grains prepared according to known processes. The resultant narrow size distribution could not have been predicted from the state of the art and is achieved by using a silver halide solvent such as ammonia, ammonia derivatives, etc. and by stopping the initial silver nitrate addition for a time period of 0.5 to 60 minutes at a bromide ion concentration in the range of 0.005N to 0.05 normal (N).

Substantially all the excess basic silver halide solvent solution e.g., ammonia, ammonia derivative, etc. present can be neutralized with acid. Optionally, the emulsion containing the final tabular grains may be ripened further by the addition of a thiocyanate salt ripening agent, e.g., alkali metal thiocyanate, for a period of about 1 to 20 minutes. The ripened emulsion after washing is then preferably chemically and spectrally sensitized as are known to those skilled in the art.

The tabular silver halide grains are of the silver bromide or silver bromoiodide types. The grains have an average thickness of about 0.05 to 0.5 μm, preferably 0.05 to 0.2 μm; an average grain volume of 0.05 to 1.0 $\mu m^3$, preferably 0.1 to 0.3 $\mu m^3$; and a mean aspect ratio of greater than 2:1, preferably greater than 5 to 1.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each grain. From this the aspect ratio of each tabular grain can be calculated, and the aspect ratios of all the tabular grains in the sample can be averaged to obtain their mean aspect ratio. By this definition the mean aspect ratio is the average of individual tabular grain aspect ratios. In practice it is usually simpler to obtain an average thickness and an average diameter of the tabular grains and to calculate the mean aspect ratio as the ratio of these two averages. Whether the averaged individual aspect ratios or the averages of thickness and diameter are used to determine the mean aspect ratio, within the tolerances of grain measurements contemplated, the mean aspect ratios obtained do not significantly differ.

Grain size dispersities of a tabular grain can be described by measuring $V\sigma g°$ which is essentially [1 plus (standard deviation of the volumes/mean volume)] and which is measured by apparatus similar to that taught by Holland et al. P.S. and E, Volume 17, No. 3 (1973), page 295 et seq. Normally the above determinations are made using tabular grains which are in the grain diameter range of 0.5 to 2.5 μm and appear tabular at 2,500 times magnification. As illustrated in FIG. 1, tabular grains prepared according to this invention have a grain size distribution approximately 27% narrower than that of tabular grains prepared by known methods.

In the preparation of the tabular grains described above the following procedure is used. Into a conventional reaction vessel for silver halide precipitation equipped with a stirring mechanism is introduced a dispersing medium/bromide mixture wherein the initial bromide ion concentration is 0.08 to 0.25N, which is the known range to produce tabular grains. Preferably the bromide ion concentration is 0.1 to 0.2N. The bromide salt present is typically in the form of an aqueous salt solution, e.g., one or more soluble ammonium, alkali metal, e.g., sodium, potassium; alkaline earth metal, e.g., magnesium or calcium. Suitable dispersing media initially present in the reaction vessel include water and a peptizer, e.g., gelatin, including alkali-treated gelatin (cattle bone or hide gelatin), acid-treated gelatin (pigskin gelatin), gelatin derivatives, e.g., acetylated gelatin, phthalated gelatin, etc.; proteins, protein derivatives, cellulose derivatives, e.g., cellulose esters; polysaccharides, e.g., dextran, gum arabic, zein, casein, pectin, collagen derivatives, agar-agar, arrowroot, albumin, etc. Mixtures of peptizers may be used. A preferred peptizer is gelatin or a gelatin derivative.

The temperature of the contents in the reaction vessel is preferably in the range of 40° to 80° C. The pH of the contents in the vessel is in the range of 3.0 to 7.0. Silver nitrate is then added at a steady rate into the reaction vessel containing the dispersing medium/bromide mixture whereby tabular seed grains begin to form. The pH is maintained in the aforementioned range.

After approximately at least 2 percent of the total silver nitrate has been added to ensure proper size tabular seed grains have been permanently formed, a basic silver halide solvent solution is added to the reaction vessel to achieve about 0.02 to 0.2N of the solvent in the vessel. The preferred solvent solution is ammonia producing a normality in the range of 0.02 to 0.2N. The percentage of silver nitrate added to ensure proper size tabular seed grains ranges from 2 to 30%, preferably 7 to 15%, based on the total weight of silver nitrate.

Upon achieving a desired bromide ion concentration in the reaction vessel, i.e., 0.005N to 0.05N, preferably 0.01N to 0.04N, and in the presence of the basic silver halide solvent, the initial silver nitrate addition is stopped for a time period of 0.5 to 60 minutes, preferably 1 to 5 minutes. During this period the tabular seed grains are permitted to ripen.

Generally ammonia, ammonia derivative or some other basic silver halide solvent is used and it is desired to neutralize at least some of the basic compound present. Preferably all the basic compound is neutralized for the narrowest size distribution. This can be accomplished by adding an acid compound, e.g., acetic acid, sulfuric acid, nitric acid, hydrochloric acid, etc. The pH achieved is in the range 5.8 to 9.0, preferably 5.8 to 7.5. Preferably the neutralizing step occurs before the final silver nitrate and halide additions are made.

Silver nitrate addition is resumed by continually adding silver nitrate into the vessel together with a halide compound which introduces additional bromide ions or bromoiodide ions by a balanced double jet (BDJ) procedure known to those skilled in the art thereby maintaining the desired bromide ion concentration. It is in this step that the tabular grains achieve their final volume and narrow size distribution and other desired properties including mean aspect ratio. In the event that bromoiodide ions are added during the BDJ procedure, the amount of iodide present in the emulsion is in the range of about 0.01 to 10.0 mol percent, preferably 0.01 to 2.0 mol percent based on total silver. After grain growth is complete, the tabular grains may be further ripened, e.g., for a time period of 1 to 20 minutes by the addition of a thiocyanate salt to the emulsion. Useful thiocyanate salts include alkali metal thiocyanates and ammonium thiocyanate, e.g., in an amount of 0.1 to 20 g salt/mole silver halide. Other ripening agents can include thioether, etc., as well as others known to those skilled in the art.

The tabular grain emulsions are preferably washed to remove soluble salts. Washing techniques are known to those skilled in the art. The washing is advantageous in terminating ripening of the tabular grains after completion of precipitation to avoid increasing their thickness and reducing their aspect ratio. While substantially all the grains are tabular in form the emulsion is not affected by the presence of a minor amount of nontabular grains. The percentage of tabular grains is determined primarily at the initial seeding stage and is substantially unchanged during subsequent stages of grain preparation.

The emulsion containing tabular grains prepared according to this invention is generally fully dispersed and bulked up with gelatin or other dispersion of peptizer described above and subjected to any of the known methods for achieving optimum sensitivity. Preferably optimum chemical sensitization is achieved by the addition of sulfur and gold. Other sensitizers include: selenium, tellurium, platinum, palladium, iridium, osmium, rhodium, rhenium or phosphorous sensitizers or combinations thereof, used at $10^{-8}$ to $10^{-10}$N silver (pAg 8 to 10), pH of 6.0 to 7.0 and temperatures of from 50° to 60° C. Chemical sensitization can occur in the presence of modifiers, e.g., compounds known to suppress fog and increase speed when present during chemical sensitization, such as azaindenes, azapyridazines, azapyrimidines, benzothiazolium salts, and sensitizers having one or more heterocyclic nuclei.

The tabular grain silver halide emulsions are also spectrally sensitized. Tabular grains of different aspect ratios can be made according to the described process; for example, large, thin tabular grains or, alternatively, thicker, smaller tabular grains can be prepared. Useful sensitizing dyes are those dyes that exhibit absorption maxima in the blue and minus blue (i.e., green and red) portions of the visible spectrum. In addition for specialized applications, spectral sensitizing dyes can be employed which improve spectral response beyond the visible spectrum, e.g., infrared absorbing spectral sensitizers. Examples of dyes include those disclosed in U.S. Pat. No. 4,425,426 col. 16, line 52 to col. 19, line 42 which is incorporated herein by reference.

Other materials commonly employed in combination with hydrophilic colloid peptizers as vehicles (including vehicle extenders, e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, maleic acid copolymers, vinylamine copolymers, methacrylic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides, etc. These additional materials need not be present in the reaction vessel during silver halide precipitation, but can be added to the emulsion prior to coating on a support.

The tabular grain emulsions are useful in photographic film elements. An emulsion can be coated in the normal manner on any of the conventional supports, e.g., preferably polyethylene terephthalate subbed in a conventional manner. Any of the other supports known to the art can also be used. Coating, wetting aides, antifoggants, antistatic agents, etc., common to most silver halide elements, can also be used in the preparation of the film elements.

Since elements prepared from the emulsions made using the process of this invention are eminently suitable for use in x-ray elements, usually the elements are coated on both sides of the support which usually is tinted with a blue dye as is known to those skilled in the x-ray art. The support may, and preferably does, have the conventional resin-type sub applied to the support and the sublayer is then usually overcoated with a thin substratum of gelatin over which the emulsion is then applied. The emulsion may be applied at coating weights of less than 5 g $Ag/m^2$, preferably less than 4 g $Ag/m^2$, for example, and then an abrasion layer of hardened gelatin applied thereto to provide protection for the silver containing layers. This element is conventionally exposed in a typical cassette with a pair of x-ray intensifying screens as is well known. Of course, this is only a preferred element employing emulsions of this invention. The emulsion can be used conveniently in any of the well-known photosensitive systems as noted below. A preferred mode of the invention is described in Example 2.

INDUSTRIAL APPLICABILITY

Photographic silver halide film elements having at least one layer of an emulsion containing the tabular silver halide grains having narrow size distribution prepared according to the process of this invention are useful in conventional areas of photography. The photographic elements are particularly useful as x-ray films, e.g., support coated on each side, in cooperation with x-ray intensifying screens. Sensitization can be in the green or blue portion of the spectrum. Other uses include: graphic arts films, color photographic films, etc.

EXAMPLES

The following examples illustrate but do not limit the invention. In the Controls and Examples the percentages are by weight. The grain size distribution is measured by a technique similar to that described by Holland et al. P.S. and E, Vol. 17, No. 3, p. 295 et seq. AR means aspect ratio.

Control 1

To a vessel containing 4000 g distilled water, 80 grams KBr solid and 100 grams photographic gelatin at 60° C. and equipped with electrodes to measure $Br^-$ concentration and apparatus to achieve vigorous mixing was added 3N $AgNO_3$ at 10 ml/minute until $Br^-$ concentration was depleted to 0.02N. At that point, double jet addition of 3N KBr solution was begun. A $Br^-$ concentration of 0.02N was maintained and flow rates of both 3N $AgNO_3$ and 3N KBr increased approximately 1 ml/minute each minute until 40 ml/m $AgNO_3$ flow rate was reached. This was maintained until 2525 ml of 3N $AgNO_3$ had been added, producing 7.57 mols of silver halide. The resultant grains were characterized as predominantly tabular with a mean volume of 0.34 $\mu m^3$, a thickness of about 0.15 $\mu m$ and an AR of 11. The dispersity of this emulsion was 1.91. The grain size distribution of the emulsion as measured was bimodal with a large peak at about 0.4 $\mu m^3$ volume and a smaller one at about 0.016 $\mu m^3$ volume. Thus, the process of this control, similar to that of the prior art, does not achieve the results of this invention.

Control 2

In a mixing vessel equipped as described in Control 1 above, 4 liters of distilled water, 76 grams KBr solid and 100 grams of gelatin were placed, dissolved and maintained at 60° C. With vigorous mixing 3N $AgNO_3$ was added at 12 ml/minute. When the $Br^-$ concentration reached 0.066N, 40 ml 12N $NH_4OH$ was added, and $AgNO_3$ addition continued at the same constant rate until the $Br^-$ concentration reached 0.01N. Then double jet addition of 3N $AgNO_3$ and 3N KBr solution was begun. The addition rate of $AgNO_3$ was increased 2 ml/min each minute and the rate of KBr solution correspondingly increased to maintain an excess $Br^-$ concentration of 0.01N. After the addition rate of $AgNO_3$ reached 94 ml/min, that rate was maintained until 2.5 liters had been added. This emulsion was found to be tabular with the following properties: Mean volume 0.34 $\mu m^3$; Thickness 0.45 $\mu m$; AR 2.2; Dispersity 2.11. This emulsion had a single grain size mode of moderately broad width and is shown as Curve A in FIG. 1.

EXAMPLE 1

In a mixing vessel as described in Control 1 above were placed 2.7 kg distilled water, 56.4 grams KBr solid and 60 grams of photographic gelatin. The gelatin was soaked, dissolved and maintained at 60° C. Before $AgNO_3$ was added, 40 m of 1.5N $H_2SO_4$ was added, lowering the pH to about 3.0. 2.5N $AgNO_3$ was then added at a constant rate of 13 ml/minute. When the $Br^-$ concentration reached 0.056N, 36 ml of 12N $NH_4OH$ was added while continuing the $AgNO_3$ addition. When the $Br^-$ concentration reached 0.015N, the $AgNO_3$ addition was stopped and the emulsion allowed to ripen. After 6 minutes, 128 ml of 1.5N $H_2SO_4$ was added, reducing the pH to about 8.15, and double jet addition of 2.5N $AgNO_3$ and 2.5N KBr was begun at 13 ml/minute, with the rate of $AgNO_3$ addition increasing 1 ml/min each minute and the KBr proportionally to maintain a 0.015N $Br^-$ excess. When 4.5 mols of $AgNO_3$ had been added, the $AgNO_3$ and KBr additions were stopped. A solution containing 4.5 g NaSCN and 15 ml water was added, along with 7.5 ml glacial acetic acid. The emulsion was then ripened 10 minutes at 60° C. This emulsion was found to be predominantly tabular with the following properties: Mean Volume 0.28 $\mu m^3$; Thickness 0.30 $\mu m$; AR 4; Dispersity 1.68.

EXAMPLE 2

In a mixing vessel equipped as described in Control 1 were placed 2.7 kg distilled water, 56.4 g KBr solid, and 60 grams photographic gelatin and the composition soaked and dissolved at 60° C. Before adding $AgNO_3$, 40 ml 1.5N $H_2SO_4$ was added, reducing the pH to approximately 3.0. 3N $AgNO_3$ was then added at a constant rate of 10 ml/minute and when $Br^-$ reached 0.056N 36 ml of 12N $NH_4OH$ was added while continuing $AgNO_3$ flow. When the $Br^-$ concentration reached 0.02N, the $AgNO_3$ addition was stopped for 3 minutes. 217 ml of 1.5N $H_2SO_4$ was added, which reduced the pH to about 6.8. Double jet addition of 3N $AgNO_3$ and 3N KBr was resumed at 10 ml/min, with the $AgNO_3$ rate increasing 1.25 ml/min each minute and the KBr rate increasing to maintain a growth bromide concentration of 0.02N $Br^-$. When the $AgNO_3$ flow reached 55 ml/m, that rate was maintained until 1.5 liters of 3N $AgNO_3$ had been added. Then 140 ml of 3.2% NaSCN and 3 ml glacial acetic acid were added and the emulsion ripened 10 minutes. This emulsion was predominantly tabular with a very narrow grain size distribution; Mean Volume 0.24 $\mu m^3$; Thickness 0.24 $\mu m$; AR 5; Dispersity 1.44.

The emulsions of this example and Control 2, above, were further dispersed with more bulking gelatin, fully sensitized with gold and sulfur, and a blue spectral sensitizing dye, N,N'-(2-(3-methyl(-2-thiazolino)vinyl)-1,4-phenylene diamine), methyl sulfate salt as is known to those skilled in the art. The usual coating and wetting aids, antifoggants and the like, were also added and the emulsion coated on a 0.007 inch (0.18 $\mu m$) blue tinted polyethylene terephthalate support to a coating weight of 4 g $Ag/m^2$. These photosensitive elements were then given a simulated x-ray exposure through a step wedge, developed, fixed, washed and dried in the normal manner. Sensitometry is set out in Table 1.

TABLE 1

| Sample | Speed | Base + Fog | Mid Gradient | Top Density |
|---|---|---|---|---|
| Control 2 | 100 | 0.34 | 2.25 | 3.38 |
| Example 2 | 98 | 0.17 | 3.03 | 3.10 |

Thus, it can be seen that a higher gradient, lower fog product is achieved sensitometrically following the procedure of this invention.

EXAMPLES 3 TO 6

Four mixes were made by procedures which were very similar except for the manner of application of ammonia and the "halt-ripening" step wherein the $AgNO_3$ addition is temporarily stopped. In all four cases, the mixing vessel initially contained 2.7 kg of distilled water, 56.4 grams of KBr solid and 60 grams of photographic gelatin. In all examples, the mixes were conducted at 60° C. with equivalent mixing, $AgNO_3$ flow rates and bromide ion concentrations. At the start of the mixes, 3N $AgNO_3$ was delivered to the vessel by submerged inlets at a constant 8 ml/minute. When bromide ion concentration in the vessel reached 0.028N, 30 ml 12.0N $NH_4OH$ were added to Examples 5 and 6. No $NH_4OH$ was added to Examples 3 and 4.

EXAMPLE 3

When bromide ion concentration reached 0.02N double jet growth was begun, using 3N KBr solution as the halide source to maintain $Br^-$ at 0.02N and increasing 3N $AgNO_3$ flow rate 2 ml/minute each minute until it reached 55 ml/minute which rate was then maintained until 1.5 liters of 3N $AgNO_3$ had been delivered. A solution containing 5.4 grams of NaSCN in 20 ml distilled water was then added and the emulsion ripened for 10 minutes, cooled, and washed by a coagulation process.

EXAMPLE 4

The procedure was similar to Example 3 except that $AgNO_3$ addition was halted upon yielding a bromide ion concentration of 0.02N, and the emulsion ripened 3 minutes before double jet growth was begun.

EXAMPLE 5

The procedure was similar to Example 4 except that 30 ml of 12.0H $NH_4OH$ was added to the emulsion when $Br^-$ concentration reached 0.028N during seeding. The ammonia remained through the $AgNO_3$ addition process, but was neutralized to about pH 5.8 using 226 ml of 1.5N $H_2SO_4$ before adding the NaSCN-water mixture.

EXAMPLE 6

The procedure was similar to Example 5 except that the ammonia was neutralized to a pH of about 5.6 using 223 ml of 1.5N $H_2SO_4$ after the 3-minute ripening with no $AgNO_3$ addition but before double jet growth. These differences are summarized in Table 2 below.

TABLE 2

| Ex. | $NH_4OH$ Addition | 3 Min Halt In $AgNO_3$ Addition | Ammonia Present During Double Jet Growth |
|---|---|---|---|
| 3 | None | No, pH 5.9 | No, pH 5.9 |
| 4 | None | Yes, pH 5.9 | No, pH 5.9 |
| 5 | Yes | Yes, pH 9.8 | Yes, pH 9.8 |
| 6 | Yes | Yes, pH 9.8 | No, pH 5.8 |

The grains produced in the above mixes were measured to have the following properties:

| Ex. | Mean Vol. ($\mu m^3$) | Thickness ($\mu m$) | AR | Dispersity |
|---|---|---|---|---|
| 3 | 0.22 | 0.12 | 13 | 2.30 |
| 4 | 0.19 | 0.12 | 11 | 2.25 |
| 5 | 0.36 | 0.27 | 5 | 2.16 |
| 6 | 0.22 | 0.19 | 6 | 1.52 |

All of the above emulsions were comparably tabular in habit, but the emulsions of Examples 3 and 4 had strongly bimodal grain size distributions. The emulsion of Example 5 had a single but relatively broad grain size distribution, while the emulsion of Example 6 had a single narrow grain size distribution.

EXAMPLES 7 AND 8

Two additional mixes were made according to this invention using larger equipment. These mixes differed principally in that the 3N double jet halide stream of Example 7 was comprised of 99% KBr and 1% KI, while that of Example 8 contained 99.5% KBr and 0.5% KI. In a 300-gallon, glass-lined emulsion mixing vessel providing excellent mixing were added 396 liters of distilled water, 8.8 kg of photographic gelatin, 8.01 kg KBr solid and, after soaking, the temperature was brought to 60° C. and 15 ml of antifoam tributyl phosphate were added. 3N $AgNO_3$ was added in a single jet at a constant 1,110 ml/minute. When 14.7 liters of $AgNO_3$ had been added 4.033 kg of 12.4N $NH_4OH$ were added. When 16.4 liters of $AgNO_3$ had been added, at which time $Br^-$ concentration was 0.044N, the $AgNO_3$ was temporarily stopped. After 2.5 minutes ripening, 10.0 kg 3N $H_2SO_4$ was added, neutralizing approximately 50% of the ammonia, double jet addition of 3N $AgNO_3$ and 3N halide was begun. The flow of 3N $AgNO_3$ was ramped to 7,500 ml/m over 15 minutes and the halide flow increased approximately concurrently to maintain an emulsion $Br^-$ concentration of 0.044N. Upon reaching 7,500 ml/m, the $AgNO_3$ flow was held constant. When approximately 178 liters of $AgNO_3$ had been added, the halide flow was stopped briefly to allow emulsion $Br^-$ to be depleted to 0.01N. Then halide flow was resumed and 0.01N $Br^-$ maintained until 220 liters of $AgNO_3$ had been added at which time both $AgNO_3$ and halide flows were stopped. 1200 grams of glacial acetic acid were added to adjust the pH to about 5.7 followed by a solution of 840 g sodium thiocyanate in 2.5 liters of distilled water. The emulsion was ripened at 60° C. for 15 minutes, cooled and coagulation-washed by a conventional process. The grains produced were predominantly tabular and had the following properties set out in Table 3 below:

TABLE 3

| Ex. | Iodide (Mol %) | Mean Vol. ($\mu m^3$) | Thickness ($\mu m$) | AR | Dispersity |
|---|---|---|---|---|---|
| 7 | 0.90 | 0.32 | 0.24 | 5 | 1.63 |
| 8 | 0.45 | 0.30 | 0.23 | 6 | 1.58 |

The emulsions were sensitized and coated on polyethyleneterephthalate film base at 4 g $Ag/m^2$ to produce x-ray films with the following photographic properties:

| Ex. | Speed | Base + Fog | Mid Gradient | Top Density |
|---|---|---|---|---|
| 7 | 76 | 0.20 | 3.66 | 4.08 |
| 8 | 72 | 0.21 | 3.41 | 3.77 |

I claim:

1. A process for the preparation of a photographic emulsion containing tabular silver halide grains having a narrow size distribution comprising A. adding silver nitrate to a vessel containing a dispersing medium/bromide mixture wherein the initial bromide ion concentration is 0.08 to 0.25 normal whereby tabular seed grains are formed;

B. adding a basic silver halide solvent solution to achieve 0.02 to 0.2 normal of the solvent after at least 2% by weight of the total silver nitrate has been added to said vessel;

C. stopping silver nitrate addition for a time period of 0.5 to 60 minutes to permit the tabular seed grains to ripen wherein the bromide ion concentration is in the range of 0.005 to 0.05 normal;

D. neutralizing at least some of the solvent that is present; and

E. adding silver nitrate and halide taken from the group consisting of $Br^-$ and $BrI^-$ by balanced double jet addition whereby the tabular grains of narrow size distribution are formed.

2. A process according to claim 1 wherein substantially all the solvent is neutralized in Step D.

3. A process according to claim 1 wherein the basic silver halide solvent is an ammoniacal solution.

4. A process according to claim 3 wherein the ammoniacal solution is ammonia.

5. A process according to claim 1 wherein 2 to 30% of the silver nitrate is added in Step A.

6. A process according to claim 1 wherein 7 to 15% of the silver nitrate is added in Step A.

7. A process according to claim 1 wherein after Step E a thiocyanate salt ripening agent is added and the emulsion is ripened for 1 to 20 minutes.

8. A process according to claim 1 wherein the emulsion is chemically and spectrally sensitized.

9. A process for the preparation of a photographic emulsion containing tabular silver halide grains having a narrow size distribution comprising A. adding silver nitrate to a vessel containing a gelatino/bromide mixture wherein the initial bromide ion concentration is 0.1 to 0.2 normal whereby tabular seed grains are formed;

B. adding an ammoniacal base solution to achieve 0.025 to 0.1 normal of the base after at least 2% of the total silver nitrate has been added to said vessel;

C. stopping silver nitrate addition for a time period of 1 to 5 minutes to permit the tabular seed grains to ripen wherein the bromide ion concentration is in the range of 0.01 to 0.04 normal;

D. neutralizing at least some of the base present with acid to a pH of 5.8 to 9.0; and E. adding silver nitrate and halide taken from the group consisting of $Br^-$ and $BrI^-$ by balanced double jet addition whereby the tabular grains of narrow size distribution are formed.

10. A process according to claim 9 wherein substantially all the ammoniacal base solution is neutralized in Step D, the pH being 5.8 to 7.5.

11. A process according to claim 9 wherein after Step E a thiocyanate salt ripening agent is added and the emulsion is ripened for 1 to 20 minutes.

12. A process according to claim 9 wherein the emulsion is chemically and spectrally sensitized.

* * * * *